United States Patent [19]

Kadowaki et al.

[11] Patent Number: 4,587,208

[45] Date of Patent: May 6, 1986

[54] COLOR PHOTOGRAPHIC LIGHT-SENSITIVE MATERIAL

[75] Inventors: Takashi Kadowaki; Kaoru Onodera, both of Odawara, Japan

[73] Assignee: Konishiroku Photo Industry Co., Ltd., Japan

[21] Appl. No.: 727,187

[22] Filed: Apr. 25, 1985

Related U.S. Application Data

[63] Continuation of Ser. No. 498,742, May 27, 1983, abandoned.

[30] Foreign Application Priority Data

Jun. 2, 1982 [JP] Japan ..... 57-95145

[51] Int. Cl.[4] ..... G03C 1/46

[52] U.S. Cl. ..... 430/507; 430/512; 430/524; 430/538; 430/961

[58] Field of Search ..... 430/512, 524, 538, 507, 430/961

[56] References Cited

U.S. PATENT DOCUMENTS

| | | | |
|---|---|---|---|
| 3,253,921 | 5/1966 | Sawdey | 430/512 |
| 3,352,673 | 11/1967 | Graham | 430/512 |
| 3,533,794 | 10/1970 | Ohi et al. | 430/512 |
| 3,622,318 | 11/1971 | Evans | 430/512 |
| 4,352,861 | 10/1982 | Van Meer et al. | 430/512 |

*Primary Examiner*—J. Travis Brown

*Attorney, Agent, or Firm*—Finnegan, Henderson, Farabow, Garrett & Dunner

[57] ABSTRACT

A color photographic light-sensitive material comprising a reflective support having thereon a plurality of silver halide emulsion layers of which the silver halide layer located farthest from the support contains not less than 15 mole percent of silver chloride and two non-light-sensitive layers each containing an ultraviolet absorbing agent.

19 Claims, No Drawings

COLOR PHOTOGRAPHIC LIGHT-SENSITIVE MATERIAL

This application is a continuation of application Ser. No. 498,742, filed May 27, 1983, now abandoned.

BACKGROUND OF THE INVENTION

The present invention relates to a color photographic light-sensitive material and, more particularly, to a color photographic light-sensitive material for use in making photographic prints.

Generally, multi-layered color photographic light-sensitive materials, e.g.; those for use in making photographic prints have, in recent years, been produced by coating their component layers on their support in the high-speed coating process capable of coating layers very rapidly. And the coating of component layers is conducted by the simultaneous multilayer coating method in which the dew point of the drying air in the drying process is very low. For this reason, static electricity frequently occurs on the light-sensitive material during the manufacture thereof.

On the other hand, static electricity also frequently occurs on the light-sensitive material during the transport thereof inside a printer in the printing process after photographing.

And the static electricity caused by these factors emits a light in wavelengths of less than about 400 nm which produces static marks on the print-making color photographic light-sensitive material; thus the static electricity is in serious question.

In the meantime, the silver halide for use in the print-making color photographic light-sensitive material consists principally of silver bromide.

Therefore, in order to prevent possible occurrence of static marks by static electricity, an ultraviolet absorbing agent having an absorbency below 460 nm, the shorter wavelength end of the inherent sensitivity range of silver bromide, should be contained in the topmost layer of the component-layers, that covers the silver halide layers.

However, such an ultraviolet absorbing agent is yellow colored due to its own absorbing characteristics, the color reducing the whiteness of the resulting print, so that the use of such agents, on the contrary, comes into serious question in the practice of the printing operation.

OBJECT OF THE INVENTION

Accordingly, the present invention has been made in view of such circumstances, and a principal object of the present invention is to provide a color photographic light-sensitive material which is not only hardly caused to produce static marks by the static electricity brought about during the component-layer coating process or during the transport of the material through the inside of a printer but also excellent in the whiteness of its finished print.

SUMMARY OF THE INVENTION

As a result of our study to accomplish the above-described object, we have now found that the object can be attained by the use of a larger silver chloride content of the uppermost silver halide emulsion layer than that ever used, and the incorporation of an ultraviolet absorbing agent whose light-absorbency is shifted toward shorter wavelength side than that of those conventionally used into the topmost nonlight-sensitive layer coated on the emulsion layers, and, further, we have found the optimum relation between the silver chloride content and the light-absorbing characteristic of the ultraviolet absorbing agent, and thus the present invention has been completed.

Namely, the present invention is of a color photographic light-sensitive material comprising a reflective support having thereon a plurality of silver halide emulsions of which the silver halide emulsion layer located farthest from the support has a silver halide containing not-less-than-15% by mole of silver chloride; and a nonlight-sensitive layer on the opposite side to the support side of the silver halide emulsion layer located farthest from the support, the nonlight-sensitive layer containing an ultraviolet absorbing agent whose ratio $A_1/A_2$ of the spectral absorption efficient $A_1$ at 350 nm to the spectral absorption efficient $A_2$ at 400 nm is not less than 10.

DETAILED DESCRIPTION OF THE INVENTION

Preferred embodiment of the invention

The embodiment of the present invention will be illustrated in detail below:

The color photographic light-sensitive material of this invention (hereinafter referred to as the light-sensitive material of the invention) has not less than two layers on the support, and, in the normal form, has three different spectral sensitivity-having light-sensitive silver halide emulsion layers each containing differently one of three couplers: nondiffusible yellow, magenta and cyan couplers.

In such a form, the respective combinations of such light-sensitive silver halide emulsion layers and couplers are, in general, the combination of a red-sensitive silver halide emulsion layer with a cyan coupler, the combination of a green-sensitive silver halide emulsion layer with a magenta coupler, and the combination of a blue-sensitive silver halide emulsion layer with an yellow couplers.

There are no particular restrictions on the coating order of such emulsion layers. However, in print-making color photographic light-sensitive materials relating to the invention, generally, an yellow coupler-containing emulsion layer, a magenta coupler-containing emulsion layer, and then a cyan coupler-containing emulsion layer are coated in this described order from the reflected support side.

As the nondiffusible yellow, magenta and cyan couplers for use in the light sensitive material of the invention, any of those known couplers may be used.

Preferred yellow couplers are α-pivaloylacetanilide-type couplers.

Preferred magenta couplers are 5-pyrazolone-type, more preferably 1-phenyl 5-pyrazolone-type, and further preferably 1-phenyl-3-amino-5-pyrazolone-type couplers and pyrazolotriazole-type couplers.

Preferred cyan couplers are phenol-type couplers.

Any of these couplers is used to be contained in a quantity of from 0.1 to 1 mole per mole of silver halide in a silver halide emulsion layer.

A silver halide in the cyan coupler-containing emulsion layer, that is, the emulsion layer being located farthest from the support, of these silver halide emulsion layers, contains not less than 15 mole % of silver chloride.

If the silver chloride content is less than 15 mole %, the end of the inherent sensitivity range largely exceeds 400 nm, so that even if such an ultraviolet absorbing agent as will be hereinafter mentioned is combinedly used, lots of static marks would be produced.

In contrast, if the silver chloride content exceeds 15 mole %, the end of the inherent sensitivity range shifts toward the wavelength about 410 nm or shorter.

Further, if the silver chloride content is less than 15 mole %, the color reproducibility would become worse.

On the other hand, if the silver chloride content is excessive, the photographic characteristics, particularly the photographic speed and fog, would become unstable.

Accordingly, in the invention, the silver chloride content is preferably from 15 to 70 mole %, and more preferably from 15 to 50 mole %.

Such a silver chloride content-having silver halide relating to the invention, although it may be either silver chloroiodobromide or silver chlorobromide, is particularly desirable to be silver chloroiodobromide.

The formation of such silver chloride content-having silver halide particles may be made by the normal mixing method or reverse mixing method. Otherwise, any of the double-jet method, PAg control double-ject method, acid method, ammoniacal method, conversion method, core-shell emulsion method, and the like, may be used.

In addition, in the present invention, the silver halide of the silver halide emulsion layer located farthest from the support should at least have such a silver chloride content. And those emulsion layers closer to the support than the emulsion layer farthest from the support may be either of such a silver chloride content-having silver halide or of any other silver halides having different contents of silver chloride.

On the opposite side to the support side of the silver halide emulsion layer farthest from the support is provided a nonlight-sensitive layer adjacent this emulsion layer.

This nonlight-sensitive layer is composed of a hydrophilic binder such as gelatin.

And the nonlight-sensitive layer contains an ultraviolet absorbing agent.

The ultraviolet absorbing agent to be used in the invention shall be such that the ratio $A_1/A_2$ of the spectral absorption coefficient $A_1$ at 350 nm to the spectral absorption coefficient $A_2$ at 400 nm is not less than 10 wherein the term "spectral absorption efficient" is as defined in the "Kagaku Daijiten" (the Encyclopedia of Chemistry) Vol. 2 pp. 812–813 and Vol. 8 p. 185, published by Kyoritsu Publishing Co., Ltd. in 1962.

In this invention, the above $A_1$ and $A_2$ are obtained in the manner that an ultraviolet absorbing agent is dissolved into a high-boiling solvent dibutyl phthalate (ratio by weight 1:1), this solution is mixed with an aqueous gelatin solution, this mixture is emulsified to be dispersed, this dispersed liquid is then coated on a transparent base so that the coating amount of the ultraviolet absorbing agent is 2 mg/dm$^2$ and then dried, and the spectral absorbances at 350 nm and 400 nm of the resulting sample are subsequently measured to be determined.

In this case, when the $A_1/A_2$ is less than 10, the light-sensitive material becomes practically unusable because of the unsatisfactory antistatic effect, resistance to light, and whiteness.

In such a case, it is desirable that the above $A_1$ is not less than 0.5, the above $A_2$ is not more than 0.09, and the $A_1/A_2$ is not less than 10.

If the $A_2$ exceeds 0.09, the whiteness becomes reduced. And if the $A_1$ is less than 0.5, the static mark preventive effect becomes reduced, and the resistance to light of the dye image becomes insufficient.

As the ultraviolet absorbing agent having such a light absorbing characteristic, there exist various kinds, among which those preferred in respect of being less diffusible in the nonlight-sensitive layer to contain the agent, less-vaporizable, and well-soluble in a high-boiling solvent are benzotriazole-type compounds.

And among benzotriazole-type ultraviolet absorbing agents, those having the above-described ultraviolet absorbing characteristic are those compounds having the formula:

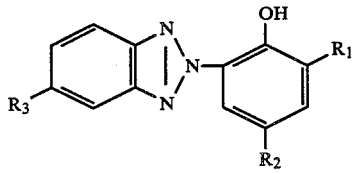

Formula [I]

wherein $R_1$, $R_2$ and $R_3$ each is hydrogen, a halogen, an alkyl, an aryl, an alkoxy, an aryloxy, an alkenyl, nitro or hydroxyl radical.

The following are examples of these ultraviolet absorbing agents having Formula [I]:

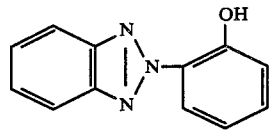

uv-1

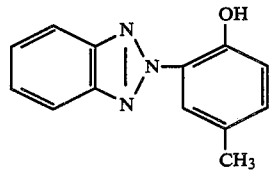

uv-2

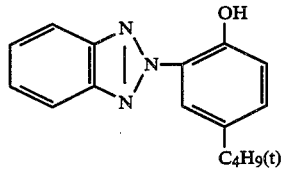

uv-3

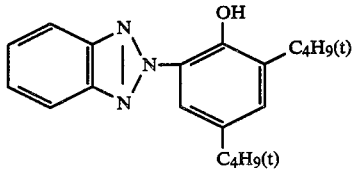

uv-4

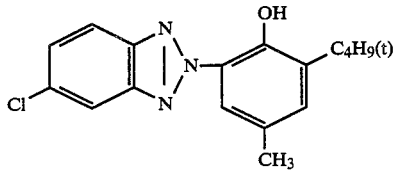

uv-5

-continued uv-6

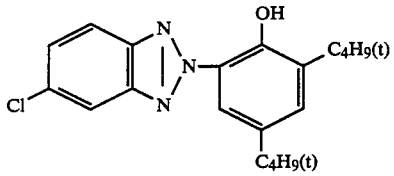

uv-7

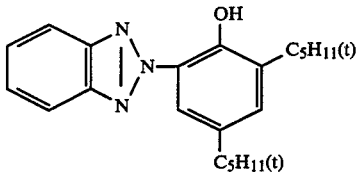

uv-8

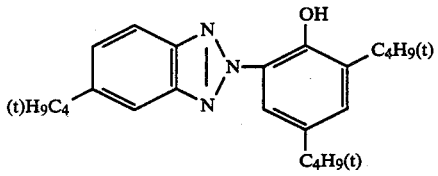

uv-9

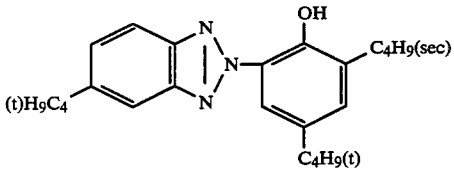

uv-10

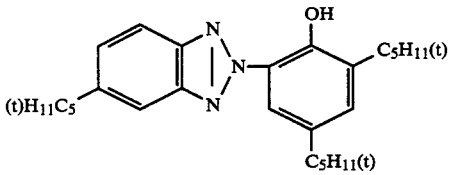

uv-11

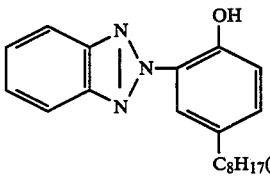

uv-12

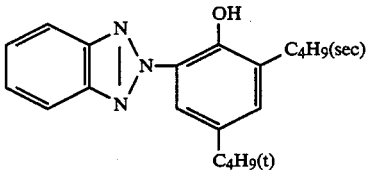

uv-13

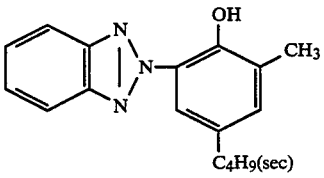

uv-14

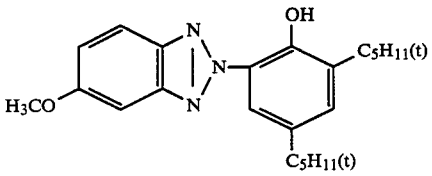

-continued uv-15

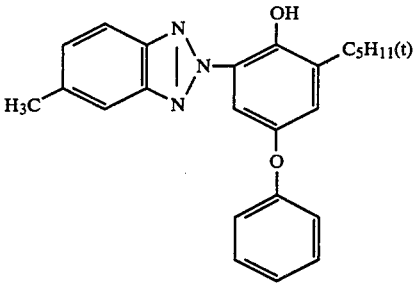

uv-16

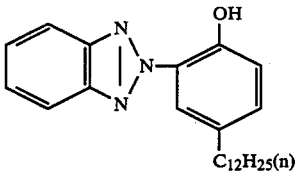

uv-17

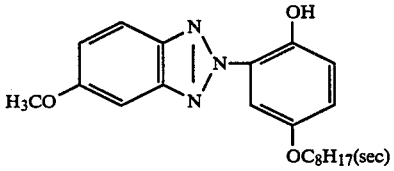

uv-18

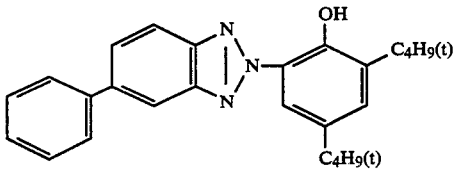

uv-19

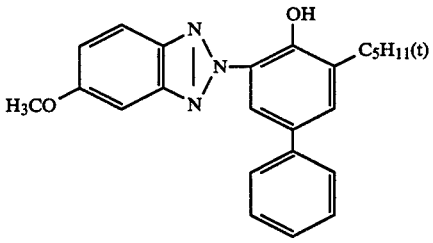

These benzotriazole-type compounds are described in Japanese Patent Examined Publication Nos. 10466/1961, 26187/1967, 5496/1973, and 41572/1973, and U.S. Pat. Nos. 3,754,919, 4,220,711, and the like.

Any of these ultraviolet absorbing agents may be incorporated in a quantity of from 0.001 to 2 parts by weight per part by weight of the binder of the nonlight-sensitive layer. And the coating amount of the binder of the nonlight-sensitive layer is normally from about 1 to about 30 mg/dm$^2$.

In addition, on the opposite to the support side of the nonlight-sensitive layer is desirable to be further formed another nonlight-sensitive layer consisting substantially of a binder alone.

The formation of this additional nonlight-sensitive layer significantly reduces the phenomenon that the surface gloss disappears with time. The coating amount of the binder of the additional nonlight-sensitive layer is also from about 1 to about 30 mg/dm$^2$.

Further, it is desirable that a first interlayer be provided in between the emulsion layer closest to the support and the intermediate emulsion layer and a second interlayer be provided in between the intermediate emulsion layer and the emulsion layer farthest from the support. And, in the second interlayer farther from the support, any of the above-mentioned ultraviolet absorbing agents is desirable to be contained. In this case, the adding quantity of the ultraviolet absorbing agent to the second interlayer is generally in a proportion of from 0.1 to 50 parts by weight per part by weight of the adding quantity of the same to the nonlight-sensitive layer formed on the emulsion layer farthest from the support.

By doing this, the static mark preventive effect and the resistance to light of the finished dye image can be improved.

In addition, the first and second interlayers each also has a hydrophilic binder, the coating quantity of which is desirable to be from 1 to 30 mg/dm$^2$.

Further, these nonlight-sensitive layer, the first and second interlayers may, if necessary, contain a color-mixing preventive agent such as dioctyl hydroquinone, dibutyl hydroquinone, etc., whiteness control agent as described in Japanese Patent Publication Open to Public Inspection (hereinafter referred to as Japanese Patent O.P.I. Publication) No. 93150/1980, coating aid, and the like.

Ultraviolet absorbing agent may also be added, if necessary, to the 1st interlayer.

The most preferred embodiment of the layer arrangements of the invention may exemplify such a multilayered arrangement, wherein, the following component layers are coated on the support in order from the support:

1st layer: a blue-sensitive emulsion layer containing yellow couplers;

2nd layer: the first interlayer comprising binders only;

3rd layer: a green-sensitive emulsion layer containing magenta couplers;

4th layer: the second interlayer in which ultraviolet-ray absorbing agents relating to the invention are dispersed in gelatin;

5th layer: a red-sensitive emulsion layer containing a silver halide relating to the invention containing not less than 15 mole % of silver chloride and also the layer containing cyan couplers;

6th layer: a non-light-sensitive layer in which ultraviolet-ray absorbing agent relating to the invention is dispersed in gelatin;

7th layer: a protective layer comprising binders only; and the like.

As the silver halide to be used in the emulsion layers excluding the emulsion layer farthest from the support out of the emulsion layers of the light-sensitive material of the present invention, in addition to the previously mentioned silver chloride content-having silver halide, any of those arbitrarily used in ordinary silver halide photographic emulsions, such as silver chloride, silver bromide, silver iodide, silver chlorobromide, silver iodobromide, silver chloroiodobromide, and the like, may be used.

The silver halide particles of the respective emulsion layers used in the present invention may be either of the coarse-grained type or of the fine-grained type, and the particle size distribution may be either wider or narrower. And the crystal form of these silver halide particles may be either of the normal type or of the twin type, and those silver halide particles of crystals having any arbitrary proportion of the [100] face to the [111] face may be used. Further, these silver halide particles may be either of the structure homogenious from the internal to the external thereof or of the structure heterogeniously stratified by the internal and the external. And these silver halides may be either of the type of forming a latent image principally on the surface of the particles thereof or of the type of forming the same inside the particles thereof.

These silver halide particles may be prepared by any of those known methods which are commonly used by those skilled in the art.

The respective silver halide emulsions used in the light-sensitive material of the present invention, although desirable to be free of soluble salts, may be used in the form of remaining undesalted.

The silver halide emulsion used in this invention may be a mixture of not less than two separately prepared different emulsions.

As the binder for use in the silver halide emulsion layer or in the nonlight-sensitive layer, those conventionally known may be used, and those suitably usable include gelatin, gelatin derivatives such as, e.g., phenylcarbamylated gelatin, acylated gelatin, phthalated gelatin, and the like. These binder materials may be used, if necessary, in the form of a compatible mixture of not less than two kinds.

The silver halide photographic emulsion prepared by dispersing silver halide particles into a binder liquid may be sensitized by a chemical sensitizer. Those chemical sensitizers advantageously usable together in the present invention are broadly classified into 4: noble-metallic sensitizers, sulfur sensitizers, selenium sensitizers and reduction sensitizers.

The noble-metallic sensitizers include gold compounds and those compounds of ruthenium, rhodium, palladium, iridium, platinum, and the like.

In addition, when a gold compound is used, ammonium thiocyanate or sodium thiocyanate may be further used together.

The sulfur sensitizers include sulfur compounds in addition to active gelatin.

The selenium sensitizers include active and inert selenium compounds.

The reduction sensitizers include stannous salts, polyamines, bisalkylammoniumsulfide, silane compounds, iminoaminomethanesulfinic acid, hydrazinium salts, and hydrazine derivatives.

On the other hand, the incorporation of an ultraviolet absorbing agent into the nonlight-sensitive layer may be made by any conventionally known method which is such that, in general, an ultraviolet absorbing agent is dissolved into a high-boiling organic solvent whose B.P. is not less than about 175° C. or, if necessary, into a mixture thereof with a low-boiling solvent, and the solution is then, using a surface active agent, finely dispersed into a hydrophilic binder such as an aqueous gelatin solution, and the resulting dispersed liquid is subsequently added to the hydrophilic colloidal layer.

To be concrete, examples of such high-boiling organic solvents are organic acid amides, carbamates, esters, ketones, urea derivatives, and the like, the esters including particularly phthalic acid esters such as, e.g., dimethyl phthalate, diethyl phthalate, dipropyl phthalate, dibutyl phthalate, di-n-octyl phthalate, diisooctyl phthalate, diamyl phthalate, dinonyl phthalate, diisodecyl phthalate, and the like; phosphoric acid esters such as tricresyl phosphate, tryphenyl phosphate, tri-(2-ethyl-hexyl)phosphate, triisononyl phosphate, and the like; sebacic acid esters such as dioctyl sebacate, di-(2-ethyl-hexyl)sebacate, diisodecyl sebacate, and the like;

glycerol esters such as glycerol tripropionate, glycerol tributyrate, and the like; and further adipic acid esters, glutaric acid esters, succinic acid esters, maleic acid esters, fumaric acid esters, citric acid esters, and the like. These esters as high-boiling solvents may be used singly or in combination.

And an ultraviolet absorbing agent is dissolved into any of these high-boiling solvents or, if necessary, into a mixture thereof with any of low-boiling solvents including methyl acetate, ethyl acetate, propyl acetate, butyl acetate, butyl propionate, cyclohexanol, cyclohexanone-tetrahydrofuran, methyl alcohol, ethyl alcohol, acetonitrile, dimethylformamide, dioxane, methyl-ethyl ketone, methyl-isobutyl ketone, diethylene-glycol monoacetate, acetyl-acetone, nitromethane, nitroethane, carbon tetrachloride, chloroform, and the like (these low-boiling solvents may be used singly or in a mixture).

The obtained solution is then mixed with an aqueous hydrophilic binder solution such as an aqueous gelatin solution containing an anionic surface active agent such as alkylbenzenesulfonic acid, alkylnaphthalenesulfonic acid, or the like, and/or a nonionic surface active agent such as a sorbitansesquioleic acid ester, sorbitan-monolauric acid ester, and the like, and the resulting mixture is subsequently emulsifiedly dispersed by means of a high-speed mixer, colloid mill or ultrasonic disperser, and the like. The thus produced dispersed liquid is subsequently added to a hydrophilic colloidal material.

As the method for dispersing nondiffusible couplers in the light-sensitive material of the present invention, various methods may be used such as the so-called aqueous alkaline solution dispersion method, solid dispersion method, latex dispersion method, oil-in-water-type emulsification dispersion method, and the like, which may be arbitrarily selected to be used according to the chemical structure of the coupler used.

In the present invention, the latex dispersion method and the oil-in-water-type emulsification dispersion method are useful. These dispersion methods have been well known, and the latex dispersion method and the effect thereof are as described in Japanese Patent O.P.I. Publication Nos. 74538/1974, 59943/1976 and 32552/1979, and Research Disclosure No. 14850, Aug. 1976, pp. 77–79.

Those latexes useful in the latex dispersion method include homopolymers, copolymers and terpolymers of such monomers as, for example, styrene, ethyl acrylate, n-butyl acrylate, n-butyl methacrylate, 2-acetoacetoxyethyl methacrylate, 2-(methacryloyloxy)ethyl-trimethylammonium methosulfate, sodium 3-(methacroyloxy)-propane-1-sulfate, N-isopropyl-acrylamide, N-[2-(2-methyl-4-oxopentyl)]-acrylamide, 2-acrylamido-2-methylpropanesulfonic acid, and the like. As the oil-in-water-type emulsification dispersion method, those conventionally known methods for dispersing hydrophobic additives such as couplers are applicable which are such that the abovementioned nondiffusible coupler is dissolved into a high-boiling solvent such as N-n-butylacetanilide, diethyllauramide, dibutyl phthalate, tricresyl phosphate, N-dodecylpyrolidone, and the like, and the solution is then finely dispersed into a hydrophilic colloid such as gelatin.

To the light-sensitive material of the present invention may be further added in addition to the above-described additives a stabilizer, development accelerator, hardening agent, surface active agent, antistain agent, lubricating agent, brightening agent, DIR material, or various other additives useful for photographic light-sensitive materials.

Further, the light-sensitive material of the present invention may be arbitrarily provided with the foregoing interlayers, a protective layer, a backing layer, and the like, besides the above-described silver halide emulsion layers and the nonlight-sensitive layer.

For the reflective support of the light-sensitive material of the present invention, those conventionally known materials such as plastic-laminated paper, baryta paper, synthetic paper or the like, may be appropriately selected according to uses, and these support materials are generally subjected to various treatments for increasing the adhesion of the photographic emulsion layer thereto.

The light-sensitive material of the present invention, after being exposed to light through a negative material having an image composed of coupling products, is subjected to a color development.

The color development is carried out in the ordinary color development process.

Namely, the exposed light-sensitive material is first processed in a color developing agent-containing color developer solution, or alternatively, a color developing agent or the precursor thereof is in advance incorporated in a light-sensitive material, and the material is exposed and then processed in a so-called activator liquid.

After that, the material, generally, is bleached and fixed in the usual way.

In that case, the color development by use of a color developer or activator liquid, the bleaching and the fixing may be carried out independently in the separate baths provided therefor, but instead can also be carried out at a time in a monobath having the functions of these processes; for example, the processing method which uses a monobath comprising a color developer or an activator liquid containing both a bleaching agent and a fixing agent which will be hereinafter mentioned or the processing method which, after color development, uses a bleach-fixing bath containing both a bleaching agent and a fixing agent.

The color development process using a color developer or activator liquid, although allowed to be immediately followed by the desilvering process using a bleach-fixing bath, may be followed by an acid stop bath processing before the bleach-fixing process. For the acid stop bath there may be used an aqueous solution of acetic acid, citric acid, or the like. And, if necessary, there may also be provided such processes as a prehardening process, a process for the neutralization thereof, washing process, stabilization process, and the like.

Through such color development processes, a dye image produced by the coupling reaction is formed on the print-making light-sensitive material.

The color developing agent for use in the development of the light-sensitive material of this invention is typified by aromatic primary amine color developing agents which include aminophenol-type compounds and P-phenylenediamine-type derivatives. These compounds may be used in the free form or in the form of organic acid salts such as hydrochlorides, sulfates, P-toluenesulfonates, tetraphenyl borates, P-(t-octyl)benzenesulfonates, or the like.

Typical examples of aromatic primary amine color developing agents are O-aminophenol, P-aminophenol, 5-amino-2-oxytoluene, 2-amino-3-oxytoluene, 2-oxy-3-amino-1,4-dimethylbenzene, N,N-di-ethyl-P-phenylenediamine hydrochloride, N-methyl-P-phenylenediamine hydrochloride, N,N-dimethyl-P-phenylenediamine hydrochloride, N-ethyl-N-β-methanesulfonaminoethyl-3-methyl-4-aminoaniline and the hydrochloride thereof, N-ethyl-N-β-hydroxyethylaminoaniline, N,N-diethyl-3-(β-methanesulfonamidoethyl)-4-aminoaniline hydrochloride, 4-amino-N-(2-methoxyethyl)-N-ethyl-3-methylaniline-P-toluenesulfonate, N-ethyl-N-β-methane sulfonamidoethyl-3-methyl-4-aminoanilinetetraphenyl borate, 4-amino-N-(2-methoxyethyl)-N-ethyl-3-methylanilinetetraphenyl borate, P-morpholinoaniline, P-piperidinoaniline, 4-amino-N,N-diethyl-3-chloroaniline, and the like.

In addition, if necessary, a color developing agent precursor may be contained in the light-sensitive material of this invention. The color developing agent precursor is a compound capable of producing a color developing agent under an alkaline condition, examples of which precursor are Schiff's base-type precursors with aromatic aldehyde derivatives, multivalent metallic ion complex precursors, phthalic acid imide derivative precursors, phosphoric acid imide derivative precursors, sugaramine-reactant precursors, urethane-type precursors, and the like.

These aromatic primary amine color developing agent precursors are as described in, e.g., U.S. Pat. Nos. 3,342,599, 2,507,114, 2,695,234 and 3,719,492, British Pat. No. 803,783, Japanese Patent O.P.I. Publication Nos. 135628/1978 and 79035/1979, and Research Disclosure Nos. 15159, 12146 and 13924.

Any of these aromatic primary amine color developing agents is contained normally in a quantity of from 1 to 20g/liter in a color developer solution. And when contained in the precursor form in the light-sensitive material, the precursor is contained normally in a quantity of from 0.5 to 3 moles per mole of silver halide.

The color developer or activator solution for use in the development of the light-sensitive material of this invention contains an alkaline agent such as potassium hydroxide, sodium hydroxide, sodium carbonate, potassium carbonate, sodium tertiary phosphate, potassium tertiary phosphate, etc.; a sulfite such as sodium sulfite, potassium sulfite, etc.; a bromide such as sodium bromide, potassium bromide, ammonium bromide, etc.; or the like. And further, if necessary, it may contain a known development restrainer other than the above; a thiocyanate such as sodium thiocyanate, potassium thiocyanate, ammonium thiocyanate, etc.; a chloride such as ammonium chloride, potassium chloride, sodium chloride, etc.; an organic solvent such as ethylene glycol, diethylene glycol, methanol, ethanol, n-butanol, benzyl alcohol, acetone, dimethylformamide, etc.; an amine such as hydroxylamine, ethanolamine, ethylenediamine, diethanolamine, etc.; a water softener such as sodium hexametaphosphate, sodium tripolyphosphate, ethylenediaminetetraacetate, diethylenetriamine pentaacetate, etc.; water-soluble brightening agent; or the like.

The color developer or activator liquid used in the present invention may also contain an auxiliary developing agent. Preferred auxiliary developing agents are 1-aryl-3-pyrazolidone derivatives, and may be used in a quantity of from 1 mg to 1 g, and preferably from 10 mg to 500 mg per liter of the color developer liquid or activator liquid. Typical auxiliary developing agents include 1-phenyl-3-pyrazolidone, 4-methyl-1-phenyl-3-pyrazolidone, 4,4-dimethyl1phenyl-3-pyrazolidone, 4-methyl-4-hydroxymethyl-1-phenyl-3-pyrazolidone, 4-methyl-4-hydroxymethyl-1-(P-tolyl)-3-pyrazolidone, and the like.

The color developer or activator solution used in the present invention is maintained alkaline in the usual way, and the hydrogen ion concentration of the solution, although arbitrarily selectable according to the kind, composition, purpose and uses of the negative material of the print-making light-sensitive material used in the invention, is generally from pH9.5 to pH13.5.

The color developer or activator solution used in the present invention is used generally within a certain temperature range. The temperature range, although arbitrarily selectable according to the kind, composition, uses and purposes of the print-making light-sensitive material of the invention, is preferably from 15° C. to 70° C., and more preferably from 30° C. to 50° C.

The bleaching agent for use in the bleaching or bleach-fixing bath may be a known compound including aminopolycarboxylic acid ferric complex salts such as, e.g., ferric-sodium ethylenediamine tetraacetate, ferric-ammonium ethylenediamine tetraacetate, and the like; and persulfates such as, e.g., ammonium persulfate, sodium persulfate, and the like. And the fixing agent for use in the bleach-fixing bath may be known compound including thiosulfates such as, e.g., sodium thiosulfate, ammonium thiosulfate, etc.; water-soluble sulfur-containing diols such as 3,6-dithia-1,8-octanediol, 3,6,9,12-tetrathia-1,14-tetradecanediol, etc.; water-soluble sulfur-containing dibasic acids such as ethylene-bis-thioglycolic acid, sodium ethylene-bis-thioglycolate, etc.; and the like.

The present invention enables not only to remarkably reduce possible occurrence of static marks on the light-sensitive material during the coating and drying of the component layers thereof or during the transport thereof through the inside of a photographic printer but also to increase the whiteness of the finished print as well as to form a very satisfactorily light-resistant dye image from the respective couplers contained in the light-sensitive material.

The present invention will be illustrated further in detail by the following examples:

EXAMPLE 1

The following first to 6th layers were coated and dried on a polyethylene-coated paper support.

First layer:

A blue-sensitive emulsion layer having a silver chlorobromide emulsion containing 10 mole % of silver chloride, prepared by the double-jet method and containing an yellow coupler Y having the formula:

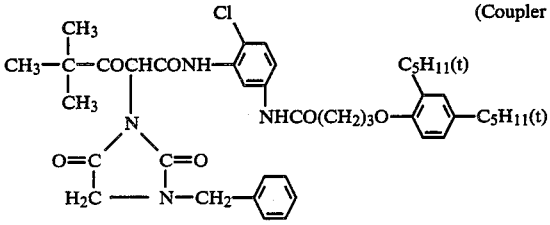

Second layer:

A first interlayer into which 2,5-di-tertiary-octylhydroquinone is dispersed.

Third layer:

A green-sensitive emulsion layer having a silver chlorobromide emulsion containing 10 mole % of silver chloride, prepared by the double-jet method, and containing a magenta coupler M having the formula:

(Coupler M)

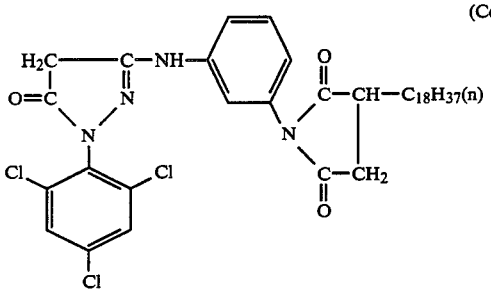

Fourth layer:

A second interlayer prepared by dispersing into gelatin 2,5-ditert-octylhydroquinone and an ultraviolet absorbing agent uv-4 (4 mg/dm$^2$).

Fifth layer:

A red-sensitive emulsion layer having two different silver chlorobromide emulsions, one containing 10 mole % silver chloride and the other containing 25 mole % silver chloride, prepared by the double-jet method, and containing a cyan coupler C having the formula:

(Coupler C)

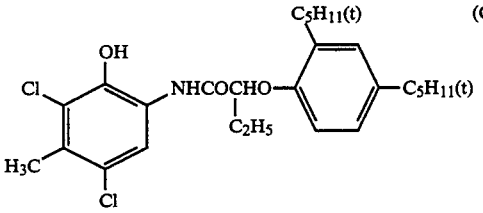

Sixth layer:

A protective layer composed of a gelatin layer or prepared by emulsifiedly dispersing into gelatin an ultraviolet absorbing agent uv-4, uv-7 or a comparative uv' having the formula:

(Coupler uv')

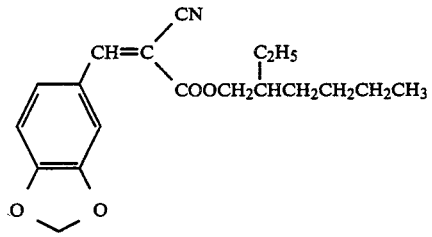

In addition, the ultraviolet absorbing agents uv-4, uv-7 and uv' each was compatibly dissolved in dibutyl phthalate in the proportion of 1:1, and the solution was emulsifiedly dispersed into an aqueous gelatin solution. The resulting dispersed liquid was then coated and dried on a transparent base support so that the coating amount of the agent is 2 mg/dm$^2$, and the thus obtained sample was measured for the spectral absorbance $A_1$ in 350 nm and the spectal absorbance $A_2$ in 400 nm. The obtained results are as shown in Table 1.

TABLE 1

| Ultraviolet absorbing agent | $A_1$ | $A_2$ | $A_1/A_2$ |
|---|---|---|---|
| uv-4 | 0.55 | 0.04 | 13.8 |
| uv-7 | 0.75 | 0.03 | 25.0 |
| uv' | 0.80 | 0.18 | 5.0 |

The above-described respective layers, after adding a coating aid and a hardening agent thereto, were coated, thereby preparing samples No. 1 to No. 14 as shown in Table 2.

In this case, for the dispersion of the above ultraviolet absorbing agents, a high-boiling solvent dibutyl phthalate was used.

The pieces cut from the respective samples were allowed to stand in the piled-up condition for about 24 hours in a room air-conditioned at 25° C. and a relative humidity of 10%. After that, the pieces were separated, peeling apart by hand, into one by one, and each of the sample pieces was developed in the following processes:

| Development process (32.8° C.) | Processing time |
|---|---|
| Color developing | 3 min. & 30 sec. |
| Bleach-fixing | 1 min. & 30 sec. |
| Washing | 3 min. & 30 sec. |
| Drying | |

Composition of color developer liquid:

| | |
|---|---|
| N—ethyl-N—β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree: 400) | 3.0 ml |
| Water to make 1 liter | |
| Add sodium hydroxide to adjust the pH to 10 | |

Composition of bleach-fixing bath:

| | |
|---|---|
| Iron-sodium ethylenediamine tetraacetate | 60.0 g |
| Ammonium thiosulfate | 100.0 g |
| Sodium hydrogensulfite | 20.0 g |
| Sodium metabisulfite | 5.0 g |
| Water to make 1 liter | |
| Add sulfuric acid to adjust the pH to 7.0 | |
| Oxidation-reduction potential: 70 mv | |

The frequency of static mark occurrence on the processed samples are as shown in Table 2.

Aside from this, each of the samples remaining unexposed was processed in the same manner as the above and measured for the spectral reflective density at 410 nm by means of a spectral color analyzer to thereby evaluate the whiteness. The obtained results are as shown in Table 2.

TABLE 2

| Sample No. | | 5th layer AgCl content | 6th layer UV absorbing agent (mg/dm$^2$) | Static mark frequency | Whiteness |
|---|---|---|---|---|---|
| 1 | (control) | | 0 | 15 | 0.01 |
| 2 | | | 2 | 7 | 0.04 |

TABLE 2-continued

| Sample No. | | 5th layer AgCl content | 6th layer UV absorbing agent (mg/dm²) | | Static mark frequency | Whiteness |
|---|---|---|---|---|---|---|
| 3 | (invention) | 25% | uv-4 | 4 | 3 | 0.05 |
| 4 | | | uv-7 | 2 | 5 | 0.03 |
| 5 | | | | 4 | 1 | 0.04 |
| 6 | | | uv' | 2 | 5 | 0.10 |
| 7 | | | | 4 | 0 | 0.13 |
| 8 | (control) | 10% | — | 0 | 17 | 0.02 |
| 9 | | | uv-4 | 2 | 14 | 0.04 |
| 10 | | | | 4 | 12 | 0.05 |
| 11 | | | uv-7 | 2 | 14 | 0.04 |
| 12 | | | | 4 | 11 | 0.04 |
| 13 | | | uv' | 2 | 7 | 0.11 |
| 14 | | | | 4 | 3 | 0.15 |

As apparent from Table 2, it is understood that samples No. 2 to No. 5 of the present invention alone show significantly small occurrence of static marks and satisfactory whiteness, so that the samples of the invention have excellent characteristics on the whole.

EXAMPLE 2

The first to 6th layers were coated in the same manner as in Example 1, and on the 6th layer a gelatin layer was coated as the 7th layer so that the coating amount is 10 mg/dm², provided ultraviolet absorbing agents uv-3, uv-7 and uv" having the following formula were used in place of the combination of the ultraviolet absorbing agents in Example 1. And samples No. 15 to No. 28 were prepared as shown in Table 4.

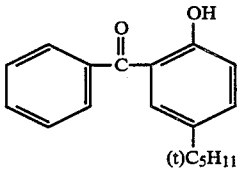

(For Coupler uv")

In addition, the $A_1$, $A_2$ and $A_1/A_2$ of uv-3, uv-7 and uv" are as shown in Table 3.

TABLE 3

| UV absorbing agent | $A_1$ | $A_2$ | $A_1/A_2$ |
|---|---|---|---|
| uv-3 | 0.83 | 0.04 | 20.8 |
| uv-7 | 0.75 | 0.03 | 25.0 |
| uv" | 0.77 | 0.14 | 5.5 |

The frequency of static mark occurrence and whiteness of these samples were measured in the same manner as in Example 1, and the obtained results are as shown in Table 4.

TABLE 4

| Sample No. | | 5th layer AgCl content | 6th layer UV absorbing agent (mg/dm²) | | Static mark frequency | Whiteness |
|---|---|---|---|---|---|---|
| 15 | (control) | | | 0 | 14 | 0.02 |
| 16 | | | uv-3 | 2 | 3 | 0.05 |

TABLE 4-continued

| Sample No. | | 5th layer AgCl content | 6th layer UV absorbing agent (mg/dm²) | | Static mark frequency | Whiteness |
|---|---|---|---|---|---|---|
| 17 | (invention) | 25 mole % | | 4 | 0 | 0.06 |
| 18 | | | uv-7 | 2 | 4 | 0.04 |
| 19 | | | | 4 | 1 | 0.06 |
| 20 | | | uv" | 2 | 12 | 0.04 |
| 21 | | | | 4 | 10 | 0.05 |
| 22 | (control) | 10 mole % | — | 0 | 14 | 0.02 |
| 23 | | | uv-3 | 2 | 12 | 0.04 |
| 24 | | | | 4 | 9 | 0.06 |
| 25 | | | uv-7 | 2 | 12 | 0.04 |
| 26 | | | | 4 | 10 | 0.05 |
| 27 | | | uv" | 2 | 14 | 0.04 |
| 28 | | | | 4 | 13 | 0.05 |

From the results in Table 4, it is apparent that the effect of the present invention is excellent.

What is claimed is:

1. A color photographic light-sensitive material comprising a reflective support having thereon a plurality of silver halide emulsion layers of which the silver halide emulsion layer located farthest from the support contains not less than 15 mole % of silver chloride, said silver halide emulsion layer farthest from the support having on the side opposite to the support side thereof a first nonlight-sensitive layer, said first nonlight-sensitive layer containing an ultraviolet absorbing agent whose ratio $A_1/A_2$ of the spectral absorption coefficient $A_1$ at 350 nm to the spectral absorption coefficient $A_2$ at 400 nm is not less than 10, and a second nonlight-sensitive layer being located between said silver halide emulsion layer farthest from the support and the silver halide emulsion layer second to the farthest from the support, the second nonlight-sensitive layer containing an ultraviolet absorbing agent whose ratio $A_1/A_2$ of the special absorption coefficient $A_1$ at 350 nm to the spectral absorption coefficient $A_2$ at 400 nm is not less than 10.

2. A color photographic light-sensitive material as claimed in claim 1, wherein the plurality of said silver halide emulsion layers are three different spectral light-sensitive silver halide emulsion layers one of said layers containing a non-diffusible yellow coupler, another of said layers containing a non-diffusible magenta coupler and the remaining of said layers containing a non-diffusible cyan coupler.

3. A color photographic light-sensitive material as claimed in claim 2, wherein the three different spectral light-sensitive silver halide emulsion layers, are a red-sensitive silver halide emulsion layer containing a cyan coupler, a green-sensitive silver halide emulsion layer containing a magenta coupler, and a blue-sensitive silver halide emulsion layer containing a yellow coupler.

4. A color photographic light-sensitive material as claimed in claim 2 or 3, wherein the plurality of said silver halide emulsion layer are coated on the reflective support in the following order: a yellow coupler containing emulsion layer, a magenta coupler containing emulsion layer, and a cyan coupler containing emulsion layer.

5. A color photographic light-sensitive material as claimed in claim 2, wherein said yellow coupler is a α-pivaloylacetanilide-type.

6. A color photographic light-sensitive material as claimed in claim 2, wherein said magenta coupler is a 5-pyrazolone-type.

7. A color photographic light-sensitive material as claimed in claim 2, wherein said cyan coupler is a phenol-type.

8. A color photographic light-sensitive material as claimed in claim 1, wherein the silver halide emulsion layer located farthest from the support contains a cyan coupler.

9. A color photographic light-sensitive material as in claim 1, wherein at least one of said nonlight-sensitive layers include a hydrophilic binder.

10. A color photographic light-sensitive material as claimed in claim 1, wherein said $A_1$ is not less than 0.5, said $A_2$ is not more than 0.09, and said $A_1/A_2$ is not less than 10.

11. A color photographic light-sensitive material as claimed in claim 1, wherein said ultraviolet absorbing agent in at least one of said nonlight-sensitive layers is a benzotriazole-type compound.

12. A color photographic light-sensitive material as claimed in claim 11, wherein said benzotriazole-type compounds have the following formula:

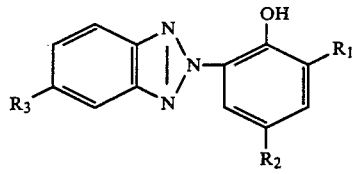

Formula [I]

wherein $R_1$, $R_2$ and $R_3$ each is hydrogen, a halogen, an alkyl, an aryl, an alkoxy, an aryloxy, an alkenyl, nitro or hydroxyl radical.

13. A color photographic light-sensitive material as claimed in claim 1, 11 or 12, wherein the contents of said ultraviolet absorbing agent are of the order of 0.001 to 2 parts by weight to one part by weight of the binders of said nonlight-sensitive layer.

14. A color photographic light-sensitive material as claimed in claim 1, wherein a third nonlight-sensitive layer comprising substantially binders only is provided on the first nonlight-sensitive layer.

15. A color photographic light-sensitive material as claimed in claim 1, wherein said silver halide is silver chlorobromide or silver chloroiodobromide.

16. A color photographic light-sensitive material as claimed in claim 12, wherein said alkyl, alkoxy and alkenyl radicals have from 1 to 14 carbon atoms respectively.

17. A color photographic light-sensitive material as claimed in claim 12, wherein said aryl and aryloxy radicals are phenyl and phenoxy radicals respectively.

18. The color photographic light-sensitive material as claimed in claim 1, wherein the quantity of the ultraviolet absorbing agent in said second nonlight-sensitive layer between said silver halide emulsion layers is from about 0.1 to about 50 parts by weight per part by weight of the quantity of the ultraviolet absorbing agent in the first non-light-sensitive layer on the side opposite to the support of said farthest silver halide emulsion layer.

19. The color photographic light-sensitive material as claimed in claim 1, wherein the silver halide in said silver halide emulsion layer farthest from the support is essentially silver bromochloride.

* * * * *